US008678622B2

(12) United States Patent
Childers et al.

(10) Patent No.: US 8,678,622 B2
(45) Date of Patent: Mar. 25, 2014

(54) WRAP-AROUND WINDOW FOR LIGHTING MODULE

(75) Inventors: Doug Childers, Portland, OR (US); David George Payne, Beaverton, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 57 days.

(21) Appl. No.: 13/458,813

(22) Filed: Apr. 27, 2012

(65) Prior Publication Data

US 2013/0286650 A1 Oct. 31, 2013

(51) Int. Cl.
*F21V 3/00* (2006.01)

(52) U.S. Cl.
USPC ..... 362/311.02; 362/367

(58) Field of Classification Search
USPC ..... 362/311.02, 367, 363, 311.01
See application file for complete search history.

(56) References Cited

U.S. PATENT DOCUMENTS

| | | | | |
|---|---|---|---|---|
| 4,471,414 | A * | 9/1984 | Savage, Jr. | 362/652 |
| 5,038,255 | A * | 8/1991 | Nishihashi et al. | 362/547 |
| 5,857,767 | A | 1/1999 | Hochstein | |
| 5,936,353 | A | 8/1999 | Triner et al. | |
| 6,200,134 | B1 | 3/2001 | Kovac et al. | |
| 6,411,022 | B1 * | 6/2002 | Machida | 313/318.1 |
| 6,457,823 | B1 | 10/2002 | Cleary et al. | |
| 6,501,084 | B1 | 12/2002 | Sakai et al. | |
| 6,517,218 | B2 * | 2/2003 | Hochstein | 362/294 |
| 6,683,421 | B1 | 1/2004 | Kennedy et al. | |
| 6,692,250 | B1 | 2/2004 | Decaudin et al. | |
| 7,976,181 | B2 * | 7/2011 | Kelly et al. | 362/217.12 |
| 2001/0046652 | A1 | 11/2001 | Ostler et al. | |
| 2002/0187454 | A1 | 12/2002 | Melikechi et al. | |
| 2003/0043582 | A1 | 3/2003 | Chan et al. | |
| 2003/0081096 | A1 | 5/2003 | Young | |
| 2005/0083323 | A1 | 4/2005 | Suzuki et al. | |
| 2012/0099326 | A1 * | 4/2012 | Hammond et al. | 362/311.02 |

FOREIGN PATENT DOCUMENTS

| | | | |
|---|---|---|---|
| DE | 19619154 | A1 | 6/1997 |
| DE | 10127171 | A1 | 12/2001 |
| EP | 0879582 | A1 | 11/1998 |
| EP | 1158761 | A1 | 11/2001 |
| EP | 1599340 | B1 | 9/2007 |

(Continued)

OTHER PUBLICATIONS

Data Sheet for G*SiC Technology Super Blue LEDs No. C430-CB290-E1200, manufactured by Opto Semiconductors, May 1, 1999, 8 pages.

(Continued)

*Primary Examiner* — Laura Tso
(74) *Attorney, Agent, or Firm* — Alleman Hall McCoy Russell & Tuttle LLP

(57) ABSTRACT

Lighting modules include a housing, a window attached to the housing, and an array of light-emitting elements that are positioned within the housing and emit light through the window. The window has a first surface and a second surface. The light from the array of light-emitting elements is emitted through the first surface and the second surface of the window. In some examples, the first surface and the second surface of the window are angled with respect to each other.

7 Claims, 1 Drawing Sheet

(56) References Cited

FOREIGN PATENT DOCUMENTS

| | | | |
|---|---|---|---|
| EP | 2045516 | A1 | 4/2009 |
| JP | 2004228263 | A | 8/2004 |
| WO | 9507731 | A1 | 3/1995 |
| WO | 0059671 | A1 | 10/2000 |
| WO | 0067048 | A2 | 11/2000 |
| WO | 0211640 | A2 | 2/2002 |
| WO | 0213231 | A2 | 2/2002 |
| WO | 03023875 | A2 | 3/2003 |
| WO | 2011097694 | A1 | 8/2011 |
| WO | 2011119434 | A2 | 9/2011 |

OTHER PUBLICATIONS

Data Sheet for 5.0 mm Blue Series LEDs No. LNG992CFB, manufactured by the Panasonic Corporation, Mar. 2001, 1 page.

Data Sheet for 3.0 mm Blue Series LEDs No. LNG997CKB, manufactured by the Panasonic Corporation, Mar. 2001, 1 page.

Data Sheet for G*SiC Technology Ultraviolet LEDs No. C395-MB290-E0400, manufactured by Cree, Inc., 2 pages.

Korean Intellectual Property Office, International Search Report and Written Opinion of PCT/US2013/038417, WIPO, Aug. 28, 2013, 9 pages.

* cited by examiner

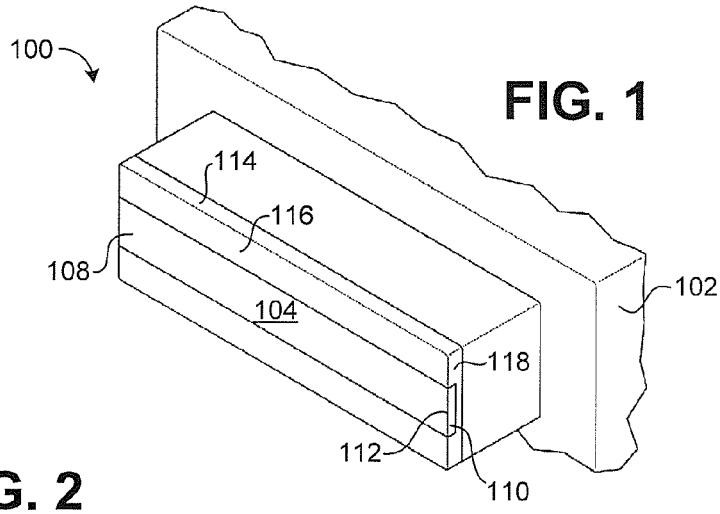
FIG. 1
FIG. 2
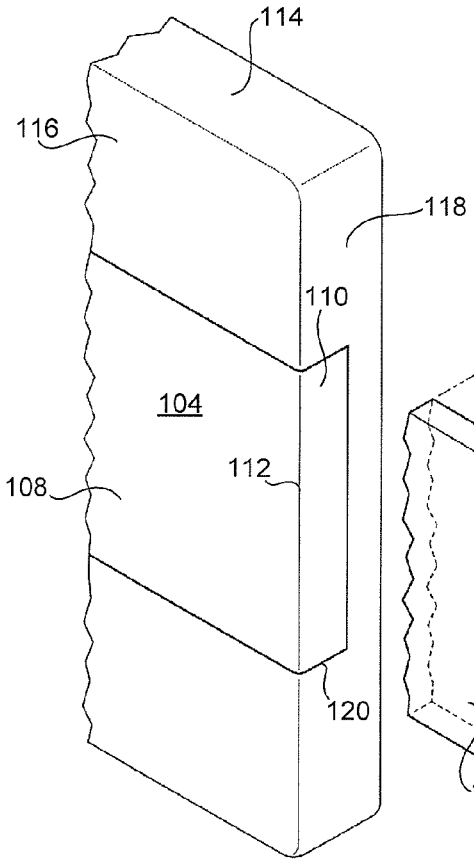
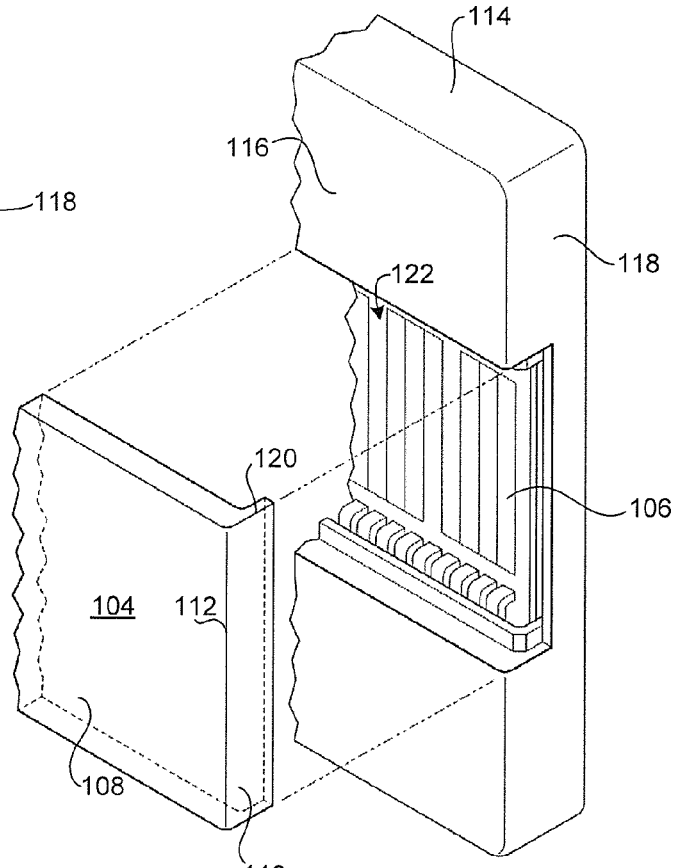
FIG. 3

WRAP-AROUND WINDOW FOR LIGHTING MODULE

BACKGROUND

Solid-state light emitters, such as light-emitting diodes (LEDs) and laser diodes, have several advantages over using more traditional arc lamps during curing processes, such as ultraviolet (UV) curing processes. Solid-state light emitters generally use less power, generate less heat, produce a higher quality cure, and have higher reliability than the traditional arc lamps. Some modifications increase the effectiveness and efficiency of the solid-state light emitters even further.

Most solid-state light emitters have a housing within which light-emitting elements, such as LEDs and laser diodes, are positioned. The light-emitting elements emit light through a window of the housing onto a substrate to cure a light-activated material to the substrate. The windows in these conventional housings emit light toward the substrate in a single direction because the windows are flat and one-dimensional. For example, a solid-state light emitter is positioned directly above a substrate with a light-activated material to cure the material to the substrate when light emitted from the emitter is directed toward the substrate. The windows used in these conventional light emitters are flat front glass and extend along some portion of the housing along a single plane that is usually facing or perpendicular to the substrate on which the curing occurs. Oftentimes, however, the surface area of the substrate being cured is larger than the width of the window and the light output uniformity decreases severely at the edges of these flat front glass windows, which causes decreases in the surface area of the substrate that receives a quality cure, the efficiency of the curing process, and the ability to stack solid-state light emitters end-to-end.

Most solid-state light emitters do not address the light output uniformity challenges and result in a lower quality cure with less efficiency and a decreased effectiveness of stacking solid-state light emitters end-to-end.

BRIEF DESCRIPTION OF THE DRAWINGS

FIG. 1 shows a front perspective view of a lighting module having a wrap-around window, according to aspects of the disclosure.

FIG. 2 shows a front perspective view of a portion of the frame and wrap-around window shown in FIG. 1.

FIG. 3 shows the frame and the wrap-around window of FIG. 2 with the wrap-around window exploded away from the frame.

DETAILED DESCRIPTION

Solid-state light emitters, or lighting modules, emit light toward a substrate having a light-activated material so that curing occurs between the light-activated material and the substrate. The disclosed lighting modules emit light in multiple directions toward the substrate by receiving light through a window in a housing of the lighting module. The windows can have more than one surface through which at least a portion of light is received so that the light is directed toward the substrate and light-activated material in more than one direction. The array of light-emitting elements can include light-emitting diodes (LEDs) and they may emit light of any desirable wavelength that is required to cure the light-activated material to the substrate. For example, the light-emitting elements emit light having a wavelength within the ultraviolet spectrum, which is approximately 10-400 nanometers (nm).

Many conventional lighting module windows are flat front glass structures that emit light toward the substrate and light-activated material from a single direction or angle, which creates areas of light output non-uniformity and thus areas of curing non-uniformity. In the example windows and lighting modules disclosed in FIGS. 1-3 and described in this application, light is emitted toward the substrate and light-activated material in more than one direction because of the shape, angle, structure, or any combination thereof of the window.

Referring now to FIGS. 1-3, a lighting module 100 has a housing 102, a window 104, and an array of light-emitting elements 106 positioned within the housing 102. The array of light-emitting elements 106 emit light through the window 104 toward a substrate and light-activated material combination (not shown in FIGS. 1-3). Light emitted by the light-emitting elements 106 can be emitted through the window 104 in multiple directions. In the examples shown in FIGS. 1-3, the window 104 is shaped to direct light away from the lighting module 100 in three directions. Specifically, the window 104 has a first surface 108 and a second surface 110 through which the light is emitted. The window 104 shown in FIGS. 1-3 also has a third surface that is opposite the second surface 108 and is not shown in these figures. The first surface 108 and the second surface 110 of the window 104 can be positioned at an angle with respect to each other or may be shaped in any other way, such as a rounded or beveled surface or any other suitable shaped (non-flat) contour.

For example, the first surface 108 and the second surface 110 of the window 104 shown in FIGS. 1-3 are angled at approximately 90° with respect to each other. However, the first surface 108 and the second surface 110 can be angled at any other suitable angle either greater than or less than 90° with respect to each other in other lighting modules 100. By varying the degree of the angle between the first surface 108 and the second surface 110 of the window 104, the direction of the light emitted from the lighting module 100 can be controlled as it is emitted toward the substrate and light-activated material combination.

The first surface 108 and the second surface 110 of the window 104 intersect each other at an edge 112 in the examples shown in FIGS. 1-3. In these lighting modules 100, the edge 112 defines a sharp corner that forms an approximately 90° angle. The edge 112 can also be rounded, beveled, or any other suitable shape or contour. The shape and contour of the edge 112 is not dependent upon, although it is related to, the angle at which the first surface 108 and the second surface 110 of the window 104 are angled. The examples shown in FIGS. 1-3 show a first surface 108 and a second surface 110 of the window 104 that are angled at approximately 90° with respect to each other and define an edge 112 where they intersect that is a corner that is approximately a 90° angle. In other examples, the first surface and the second surface of the window can be angled at greater than 90° with respect to each other and can also have an edge that is a sharp corner, or is beveled, rounded, or the like. Any suitable combination of angles between the first surface and the second surface of the window and shapes and contours of the edges of the window may be used.

Further, the window 104 shown in FIGS. 1-3 is generally U-shaped and "wraps" or otherwise extends around a portion of the housing 102 of the lighting module 100. This wrap-around window structure permits light to be emitted toward the substrate and light-activated material combination in at least three directions away from the lighting module 100: directly away from the first surface 108 of the window 104 and away from both side surfaces 110, not shown of the window 104. The side surfaces 110, not shown of the window 104 can both be the same angle and shape with respect to the first surface 108 of the window 104 or may be different angles and shapes with respect to the first surface 108 of the window 104.

FIG. 1 shows a front perspective view of a lighting module 100 that has a housing 102, a frame 114, and a window 104. The frame 114 is attached to and extends away from the housing 102 and may or may not be removable from the housing 102. The frame 114 has a first surface 116 and a second surface 118 that are coincident with the first surface 108 and the second surface 110 of the window. While the lighting module 100 shown in FIGS. 1-3 includes a frame 114, some other lighting modules do not include a frame. In yet other lighting modules, the frame forms an integral part of the lighting module housing. FIG. 1 shows that the first surface 108 of the window 104 extends along at least a portion of the first surface 116 of the frame 114 and the second surface 110 of the window 104 extends along some portion of the second surface 118 of the frame 114. The first surface 108 of the window 104 shown in FIG. 1 has a width that extends along the entire width of the first surface 116 of the frame 114 and a height that extends along only a portion of the height of the first surface 116 of the frame 114. The first surface 108 of the window 104 in FIG. 1 is positioned approximately midway along the height of the first surface 116 of the frame 114, although the first surface of the window can be positioned in any other suitable position along the height of the first surface of the frame in other examples.

FIG. 2 shows a portion of one side of the frame 114 and the window 104 shown in FIG. 1. The side surface or second surface 110 of the window 104 defines a flange 120 that wraps-around a portion of a side surface or second surface 118 of the frame 114. The second surface 110 of the window 104 extends along approximately half of the second surface 118 of the frame 114 in the lighting module 100 shown in FIG. 2, but can extend along any other desired portion of the second surface of the frame in other examples. The second surface 110 of the window 104 is also the same height as the first surface 108 of the window 104 in the lighting module 100 shown in FIG. 2. In other lighting modules, the second surface of the window is a different height or varies in shape or contour to the first surface of the window.

FIG. 3 shows an exploded view of the portion of the side of the frame 114 and window 104 shown in FIG. 2. The exploded view shows that the frame 114 includes an opening 122 into which the window 104 is fitted. In this lighting module 100, the opening 122 of the frame 114 is shaped so that the window 104 is snugly fitted into the opening 122 and the first surface 108 of the window 104 and the first surface 116 of the frame 114 create a relatively smooth surface along the same plane as each other and the second surface 110 of the window 104 and the second surface 118 of the frame 114 also create a relatively smooth surface along the same plane as each other. In other lighting modules, the first surface and/or the second surface of the window can be raised, inset, concave, convex, or some combination thereof with respect to the first and/or second surface of the frame. Concave and convex embodiments may incorporate various optical qualities for directing the light emitted from the lighting module in a particular direction or with a desired angle, depending on the construction.

FIG. 3 also shows the array of light-emitting elements 106 that are positioned within the housing 102. When the array of light-emitting elements 106 emit light, the light is emitted through the first surface 108 and the second surface 110 (or both side surfaces, depending on the embodiment) of the lighting module 100. A method of curing may include emitting light from the array of light-emitting elements that are positioned within the housing that includes a window having a first surface and a second surface. A portion of the emitted light is received through the first surface of the window and a second portion of the emitted light is received through the second surface of the window.

Some lighting modules are stacked together in an end-to-end arrangement horizontally, vertically, or any combination thereof. This type of lighting module end-to-end stacked arrangement can be customized to the dimensions of the substrate that is being cured. With the wrap-around window structure, the light emitted from the array of light-emitting elements along the seam between the windows of the stacked lighting modules will remain generally uniform. The stacked lighting modules with the disclosed wrap-around window structures promote a uniform emission of light along the edges of the windows of each lighting module.

As discussed above, some lighting modules have windows that wrap around or otherwise extend along two or more side surfaces of some portion of the housing of the lighting module, such as an optional frame. In the stacked lighting module arrangement, the lighting module positioned within a center portion of the stacked arrangement and bordering another lighting module on all sides may include windows having sides surfaces that are the same shape and contour. For the lighting modules that are positioned along an end or the perimeter of the stacked arrangement and having at least one side surface exposed rather than positioned next to another lighting module, the sides surface of the windows may be the same shape and contour or may be different shapes and contours.

For example, a lighting module positioned along the perimeter of a stacked lighting module arrangement has two opposing side surfaces. The first side surface is positioned adjacent to a side surface of a neighboring lighting module in the stacked arrangement and is angled approximately 90° with respect to the first surface of the window. The second side surface of the window that is not positioned adjacent to another lighting module in the stacked configuration is angled at a greater than 90° angle with respect to the first surface of the window and can also have a rounded or beveled edge.

Many benefits of the disclosed lighting modules have been discussed. However, additional benefits not discussed herein will become apparent to one of skill in the art upon reading this disclosure. Also, some elements of the disclosed lighting modules may be replaced with suitable substitute elements. Although there have been described to this point particular embodiments for a method and apparatus for lighting modules, it is not intended that such specific references be considered as limitations upon the scope of this invention except in-so-far as set forth in the following claims.

What is claimed is:

1. A lighting module, comprising:

a housing;

a frame attached to and extending away from the housing, the frame having a first surface and a second surface;

a window attached to the frame, the window having a first surface that extends along at least a portion of the first surface of the frame and a second surface that extends along at least a portion of the second surface of the frame; and an array of light-emitting elements positioned within the housing that emits light through the first surface and the second surface of the window.

2. The lighting module of claim 1, wherein the frame includes an opening and the window is fitted into the opening.

3. The lighting module of claim 1, wherein the first surface of the window extends along the length of the first surface of the frame and the second surface of the window extends along a portion of a length of the second surface of the frame.

4. The lighting module of claim 3, wherein the second surface of the window extends along the majority of the length of the second surface of the frame.

5. The lighting module of claim 1, wherein the first surface of the window and the second surface of the window intersect at an edge that defines an approximately 90° angle.

6. The lighting module of claim 1, wherein the first surface of the window and the second surface of the window intersect at an edge that is at least one of rounded and beveled.

7. The lighting module of claim 1, wherein the light emitted from the array of light-emitting elements includes ultraviolet light.

* * * * *